US007377363B2

(12) United States Patent
Flynn et al.

(10) Patent No.: US 7,377,363 B2
(45) Date of Patent: May 27, 2008

(54) ELEVATOR WITH VARIABLE DRAG FOR CAR AND COUNTERWEIGHT

(75) Inventors: Michael P. Flynn, Avon, CT (US); Harold Terry, Avon, CT (US)

(73) Assignee: Otis Elevator Company, Farmington, CT (US)

( * ) Notice: Subject to any disclaimer, the term of this patent is extended or adjusted under 35 U.S.C. 154(b) by 393 days.

(21) Appl. No.: 10/544,141

(22) PCT Filed: Feb. 24, 2003

(86) PCT No.: PCT/US03/05700

§ 371 (c)(1),
(2), (4) Date: Jul. 28, 2005

(87) PCT Pub. No.: WO2004/076323

PCT Pub. Date: Sep. 10, 2004

(65) Prior Publication Data

US 2006/0175142 A1 Aug. 10, 2006

(51) Int. Cl.
*B66B 1/34* (2006.01)

(52) U.S. Cl. ..... 187/284; 187/292; 187/293; 318/77; 318/626; 318/467

(58) Field of Classification Search ..... 187/284, 187/292, 256, 406, 408
See application file for complete search history.

(56) References Cited

U.S. PATENT DOCUMENTS

| | | | | |
|---|---|---|---|---|
| 2,874,806 A | | 2/1959 | Oplinger | |
| 3,207,265 A | | 9/1965 | Lund | |
| 3,747,710 A | * | 7/1973 | Winkler | 187/295 |
| 3,902,572 A | * | 9/1975 | Ostrander | 187/293 |
| 4,240,527 A | * | 12/1980 | Vine | 187/387 |
| 4,570,755 A | | 2/1986 | Tsai et al. | |
| 5,310,124 A | * | 5/1994 | Linari et al. | 242/418.1 |
| 5,349,854 A | * | 9/1994 | Garrido et al. | 73/490 |
| 5,495,919 A | * | 3/1996 | Ericson et al. | 187/373 |
| RE36,034 E | * | 1/1999 | Sheridan | 188/171 |
| 6,164,416 A | * | 12/2000 | Laine et al. | 187/284 |
| 6,202,796 B1 | * | 3/2001 | Lee | 187/293 |
| 7,222,698 B2 | * | 5/2007 | Hanninen | 187/393 |
| 2006/0278478 A1 | * | 12/2006 | Pribonic et al. | 188/159 |

* cited by examiner

*Primary Examiner*—Lincoln Donovan
*Assistant Examiner*—Eduardo Colon-Santana
(74) *Attorney, Agent, or Firm*—Carson, Gaskey & Olds

(57) ABSTRACT

An elevator car and counterweight system is provided with a variable drag element. The variable drag element is controlled such that the lower of the counterweight and the car has a higher drag against further movement. In an embodiment which is particularly useful in a 2:1 roping system, the sheaves (54, 58) associated with the counterweight (56) and the car (60) receive a braking/drive motor (62, 64) to provide the variable drag. While the present invention provides the variable drag to compensate for vertical differences between the counterweight and car, the invention can also be utilized to hold the car at a particular floor. Further, this invention can be utilized to address a counterweight or car jump situation. Another disclosed drag element may be a magnetizable member (40, 33) guided along a guide rail (34, 36) for each of the car (32) and the counterweight (38). A control controls the magnetic force associated with the guide elements to hold the car or prevent counterweight jump.

12 Claims, 2 Drawing Sheets

ELEVATOR WITH VARIABLE DRAG FOR CAR AND COUNTERWEIGHT

BACKGROUND OF THE INVENTION

This application relates to an improvement to vary the drag associated with an elevator car and counterweight, particularly as each approach extreme ends of their travel range.

Elevators are typically provided with an elevator car that moves upwardly and downwardly within an elevator shaft. As is known, and as shown somewhat schematically in FIG. 1, the car 12 is balanced by a counterweight 14. The two are connected by a rope 16. Sheaves 18 and 20 guide the rope.

In the prior art, and particularly as the elevator car or counterweight reach extreme ends of travel, one of the two becomes lighter than the other. The hoist rope is more on one side and thus the hoist rope adds more weight to the lower of the hoist car and counterweight. This raises some complications and challenges in providing smooth travel for the car 12. In particular, in very high rise applications, the provision of adequate counterweight balance forces at extreme positions of the counterweight or car becomes very challenging. Thus, compensating ropes 22 have sometimes been utilized. It would be desirable to eliminate the compensating ropes, such as rope 22.

Other issues with regard to the control of movement of an elevator car and counterweight include a problem known as "releveling" in which the car may move slightly once stopped at a floor. Further, a condition known as "counterweight jump" or "car jump" can occur at the end of travel if the car or counterweight strikes a buffer in the pit. The other of the car or counterweight may continue in an upward direction due to stored inertia. The rope tension on the lower element may become low such that its rope can become slack resulting in slip at the traction sheave. As the counterweight subsequently drops, the rope will become taut again.

Thus, the present invention eliminates the need for compensating ropes, and provides smoother travel for the elevator particularly at extreme ranges of travel.

SUMMARY OF THE INVENTION

In one disclosed embodiment of this invention, a variable drag is associated with both the car and the counterweight. The drag is increased on the lighter of the two elements as they approach their extreme ends of travel. At the same time, the other element is driven. Thus, as the counterweight reaches lower points of travel, and conversely the car reaches higher points of travel, the car will become lighter relative to the counterweight, due to the hoist rope. The drag associated with the car will then be made to be higher than the drag associated with the counterweight. The counterweight rope portion is driven. In this way, the differences in weight can be addressed.

In an embodiment that is particularly useful in a 2:1 arrangement, the lower sheaves for the counterweight and car are provided with braking/drive motors. The braking motors thus provide the variable drag on one sheave such as described above while driving the other sheave.

A control monitors position and/or speed of the car and counterweight and controls the drag accordingly.

While the present invention is particularly useful to compensate for differences in weight between the counterweight and car during travel, the drag control elements can also be utilized to hold the car at a select position such as while it is stopped at a floor.

Another feature provided by this invention occurs if the car or counterweight strikes the buffer in the pit. The other of the car and counterweight will then continue in an upward direction due to stored inertia. In this event, the rope tension on the upwardly moving element becomes low such that the rope becomes briefly slack and may result in slip at the traction sheave, and perhaps jerk as the element subsequently drops and the rope again becomes taut. The present invention also allows the control feature of activating the drag control if such a strike is sensed. This reduces dynamic forces on the suspension ropes and the building.

In another embodiment that can be used in 1:1 elevator arrangements, a magnetically controlled element with a variable magnetic force is guided on the guide rails for the car and the counterweight. By controlling the magnetic force, the amount of drag on the car and the counterweight can be controlled relative to each other. While this embodiment may not eliminate compensating ropes, the "hold" and "strike" features mentioned above can be provided by this embodiment.

These and other features of the present invention can be best understood from the following specification and drawings, the following of which is a brief description.

DETAILED DESCRIPTION OF THE PREFERRED EMBODIMENTS

Figure 1:
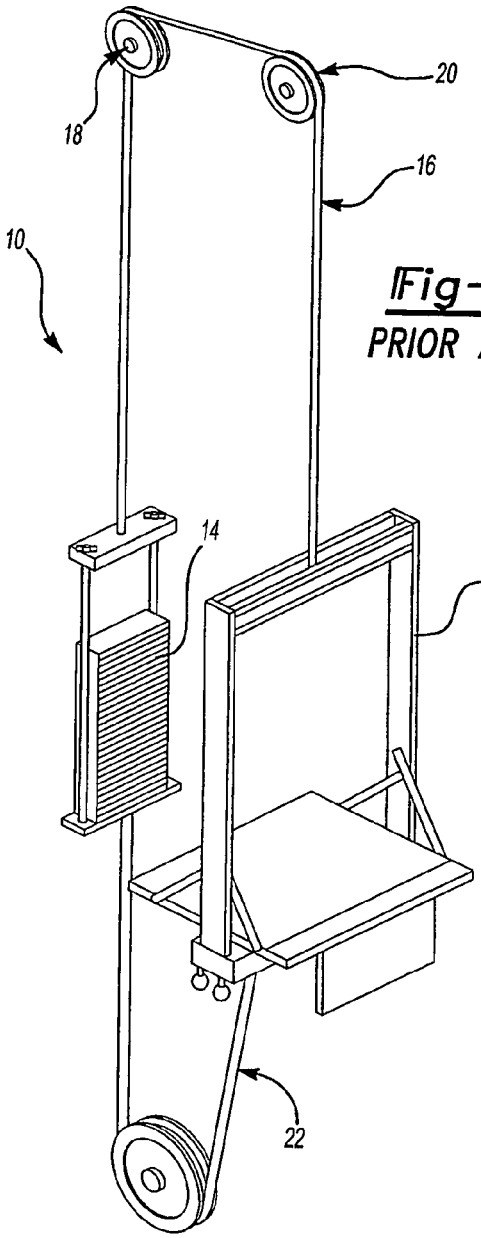
Fig-1 PRIOR ART
FIG. 1 shows a prior art elevator arrangement.
Figure 2:
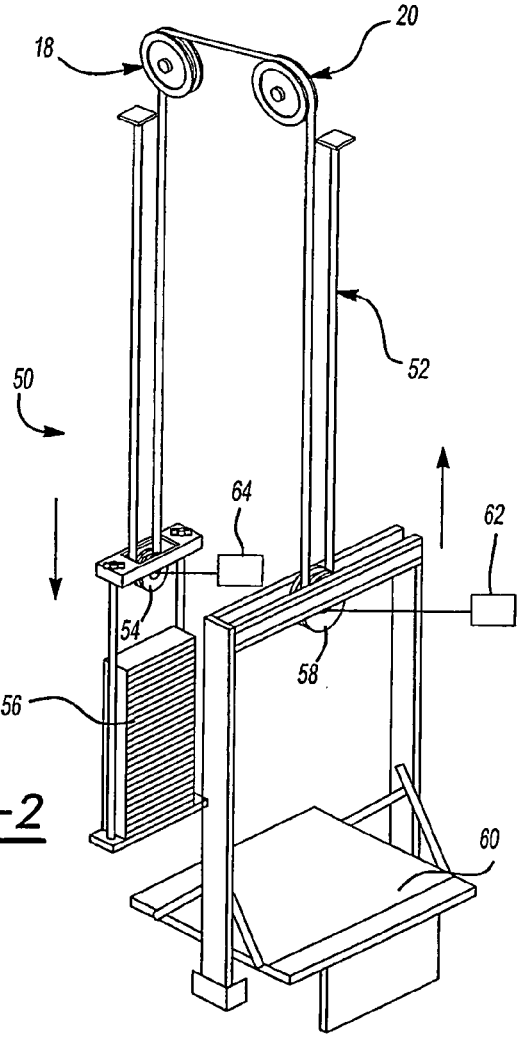
FIG. 2 is a schematic view of an inventive system.

FIG. 2 shows an embodiment 50 that is a 2:1 arrangement between the car 60 and the counterweight 56. As is shown, with such an arrangement, the rope 52 passes over sheaves 54 and 58 associated with the counterweight 56 and car 60, respectively. The sheaves 54 and 58 are provided with braking/drive motors 62 and 64 under the control of an elevator control such as, for example, control 42 shown in FIG. 3. The operation of the braking/drive motors 62, 64 serves to provide a variable drag upon the roller sheaves 54 and 58, to achieve the following control functions.

The control controls both motors 62 and 64. In the illustrated position, the counterweight 56 is moving lower than the car 60. With this movement, the counterweight 56 will reach a higher weight than the car 60. In such a situation, the counterweight would not be acting to provide the counterweight benefit as adequately as if the car and counterweight were at more approximately equal vertical positions. This problem becomes particularly acute in very high rise applications. Thus, when the counterweight is below the car, the motor 64 is controlled to brake sheave 54 to compensate for the greater weight of counterweight 56. At the same time, the other motor 62 brakes sheave 58 to compensate for the imbalance. Conversely, when the car is near the bottom of the path of travel, motor 62 will be controlled to brake sheave 58, with sheave 54 being braked by motor 64. Similarly, when the car or counterweight is at the bottom of the hoistway and it has to move upward, the motors 62 and 64 on the car and counterweight would drive the sheaves 54 and 58, thereby equalizing the rope tension on car and counterweight. Such control can be utilized based upon position or speed of the counterweight 56 or car 60. The control 42 (see FIG. 3) is well within the ability of a worker in this art, and determining the amount of drag to compensate for the imbalance in height would also be well within the skill of a worker in this art. Moreover, information such as position and/or speed is already typically provided to a control for elevators, and thus the provision of the necessary inputs for control 42 to operate to control the motors 62 and 64 is within the skill of a worker in this art.

This embodiment thus allows a variable drag to be applied to either the counterweight or car to control imbalances in weight due to extreme differences in the vertical position of the counterweight and car. This provides benefits as would be appreciated within this art. Braking/drive motors 62 and 64 can also be utilized to hold the car at a desired location, and eliminate releveling. The variable drag can be utilized to hold the car at a floor. Thus, while stopped at a floor, the car may be held at an exact desired position.

Another feature provided by this invention occurs if the car or counterweight strikes the buffer in the pit. The other of the car and counterweight will then continue in an upward direction due to stored inertia. In this event, the rope tension on the upwardly moving element becomes low such that the rope becomes briefly slack and may result in slip at the traction sheave, and perhaps jerk as the element subsequently drops and the rope again becomes taut. The present invention also allows the control feature of activating the drag control if such a strike is sensed. This reduces dynamic forces on the suspension ropes and the building.

Figure 3:
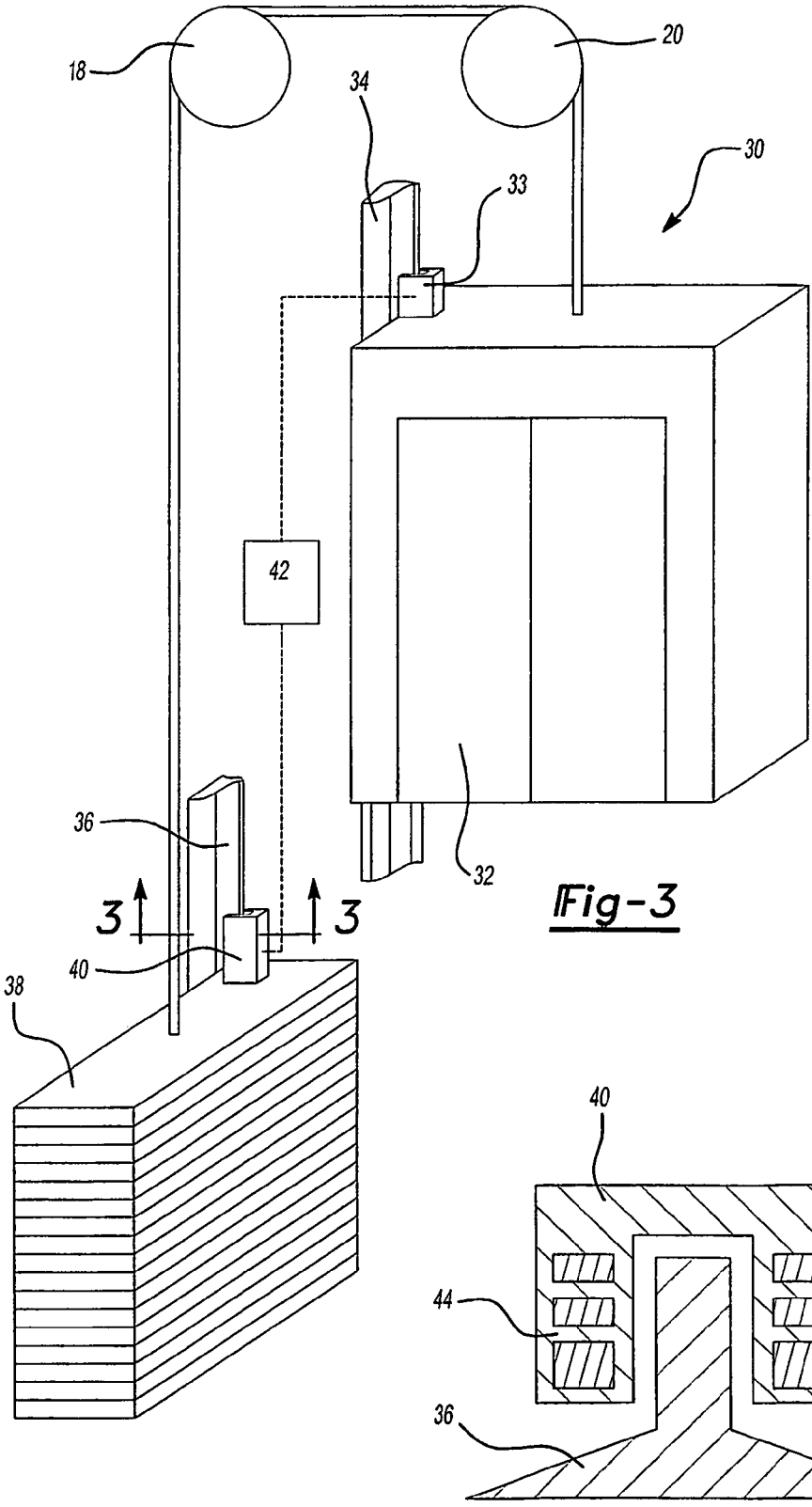
FIG. 3 shows another embodiment

An elevator system 30 is illustrated in FIG. 3 having a car 32 provided with a drag element 33 to be guided on guide rails 34. As is known, cars are guided on guide rails in standard elevator systems. However, as will be explained in greater detail below, the drag element 33 is operated to control the amount of drag between the element and the guide rail. A similar guide rail 36 guides the counterweight 38 through a similar drag control member 40.

While it is preferred to have a drag element associated with both the car and counterweight, it is possible that a single drag element associated with either the car or counterweight would achieve the control.

Figure 4:
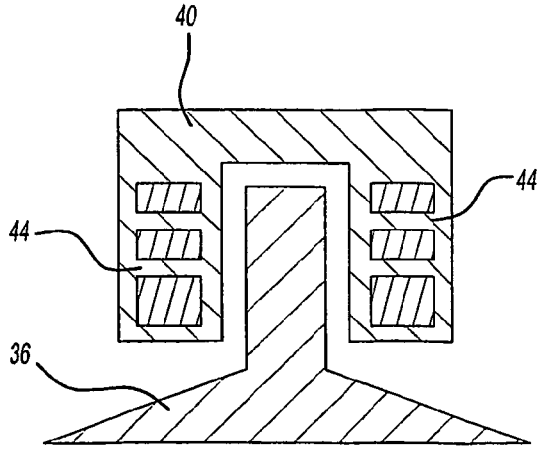
FIG. 4 is a cross-sectional view through a portion of the FIG. 3 embodiment.

As shown in FIG. 4, in one embodiment, the rail 36 receives sides 44 of the drag control element 40. These sides include magnetizable materials that can be controlled by an electric current to control the amount of magnetic force. In this way, the drag provided along the guide rails 36 and 34 by the elements 33 and 40, respectively, can be varied and controlled.

The second embodiment shown in FIGS. 3 and 4 will address the releveling and counterweight or car jump problem discussed above.

Although preferred embodiments of this invention have been disclosed, a worker of ordinary skill in this art would recognize that certain modifications would come within the scope of this invention. For that reason, the following claims should be studied to determine the true scope and content of this invention.

The invention claimed is:

1. An elevator system comprising:

an elevator car;

a counterweight;

a rope connecting said elevator car and said counterweight; and a drag element associated with at least one of said car and said counterweight, a control controlling the amount of drag between said car and said counterweight through said drag element to control movement of said car and said counterweight under at least some conditions, wherein said at least some conditions include said car having a different vertical position in said system relative to said counterweight.

2. An elevator system as set forth in claim 1, wherein said drag element includes a magnetizable member which is guided along a guide rail for said one of said car and said counterweight.

3. An elevator system as set forth in claim 1, wherein a drag element is associated with each of said car and said counterweight.

4. An elevator system as set forth in claim 3, wherein said control controls said drag elements based upon the vertical position of said car and said counterweight.

5. An elevator system as set forth in claim 1, wherein the control senses for a potential "jump" condition as one of said counterweight and car reaches an end of travel position, and said drag element being actuated should a "jump" condition be identified.

6. An elevator system as set forth in claim 1, wherein said drag element is utilized to hold said car at a floor.

7. An elevator system as set forth in claim 1, wherein said control controls said drag element to ensure that the one of said car and said counterweight having a lower vertical position relative to the other of said car and said counterweight is provided with a lower drag than the other of said car and said counterweight.

8. An elevator system comprising:

an elevator car;

a counterweight;

a rope connecting said elevator car and said counterweight;

a drag element associated with each of said car and said counterweight; a control controlling the amount of drag between said car and said counterweight through said drag element to control movement of said car and said counterweight under at least some conditions;

wherein said control controls said drag elements based upon the vertical position of said car and said counterweight; and wherein said control controls said drag elements to ensure that the vertically lower of said car and said counterweight is provided with a lower drag than the vertically higher of said car and counterweight.

9. An elevator system as set forth in claim 8, wherein said counterweight and said car are linked together in a 2:1 arrangement, and a sheave is associated with said counterweight and said car, and said drag elements are associated with said sheave on at least one of said counterweight and said car.

10. An elevator system as set forth in claim 9, wherein said drag elements are braking/drive motors.

11. A method of controlling the travel of an elevator car comprising the steps of:

(1) providing an elevator car linked to a counterweight through a rope;

(2) providing a drag element associated with at least one of said car and said counterweight, and said drag element being capable of providing a variable drag under the control of a control element; and (3) monitoring the vertical position of at least one of said car and said counterweight, and controlling the variable drag of said drag elements such that the vertically lower of said counterweight and said car has a higher drag resistance.

12. The method of claim 11, wherein step (2) includes providing a drag element to each of said car and said counterweight.

* * * * *